US009942687B1

(12) United States Patent
Chemistruck et al.

(10) Patent No.: US 9,942,687 B1
(45) Date of Patent: Apr. 10, 2018

(54) SYSTEM FOR LOCALIZING CHANNEL-BASED AUDIO FROM NON-SPATIAL-AWARE APPLICATIONS INTO 3D MIXED OR VIRTUAL REALITY SPACE

(71) Applicant: Microsoft Technology Licensing, LLC, Redmond, WA (US)

(72) Inventors: Michael Chemistruck, Redmond, WA (US); Hakon Strande, Woodinville, WA (US); Ashutosh Vidyadhar Tatake, Seattle, WA (US); Noel Richard Cross, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/701,144

(22) Filed: Sep. 11, 2017

Related U.S. Application Data

(60) Provisional application No. 62/479,157, filed on Mar. 30, 2017.

(51) Int. Cl.
*H04R 5/02* (2006.01)
*H04S 7/00* (2006.01)
(Continued)

(52) U.S. Cl.
CPC ..... *H04S 7/304* (2013.01); *H04S 7/302* (2013.01); *H04S 7/306* (2013.01); *H04R 3/005* (2013.01);
(Continued)

(58) Field of Classification Search
CPC .. H04S 2400/01; H04S 7/304; H04S 2400/11; H04S 7/302; H04S 5/005; H04S 7/306; H04R 5/033; H04R 3/005
(Continued)

(56) References Cited

U.S. PATENT DOCUMENTS 7,079,658 B2 7/2006 Lapicque
8,831,255 B2 9/2014 Crawford et al.
(Continued)

FOREIGN PATENT DOCUMENTS

CN 104284291 A 1/2015

OTHER PUBLICATIONS

"Spatial sound | Google VR | Google Developers", https://web.archive.org/web/20170107105049/https:/developers.google.com/vr/concepts/spatial-audio, Published on: Jan. 7, 2017, 14 pages.
(Continued)

*Primary Examiner* — Paul S Kim
(74) *Attorney, Agent, or Firm* — Workman Nydegger

(57) ABSTRACT

Rendering audio for applications implemented in an MR or AR system, in a 3D environment. A method includes determining a location of a user device in the 3D environment. The method further includes accessing a set of spatial mapping data to obtain spatial mapping data for the determined location. The spatial mapping data includes spatial mapping of free-space points in the 3D environment. Data for each free-space point includes data related to audio characteristics at that free-space point. The spatial mapping data is based on data provided by users in the 3D environment. The method further includes applying the spatial mapping data for the determined location to one or more acoustic simulation filters. The method further includes using the one or more acoustic simulation filters with the spatial mapping data applied, rendering audio output for one or more applications implemented in the MR or AR system to a user.

20 Claims, 13 Drawing Sheets

(51) Int. Cl.

| | |
|---|---|
| *H04S 5/00* | (2006.01) |
| *H04R 3/00* | (2006.01) |
| *H04R 5/033* | (2006.01) |

(52) U.S. Cl.
CPC ..... *H04R 5/033* (2013.01); *H04S 5/005* (2013.01); *H04S 2400/01* (2013.01); *H04S 2400/11* (2013.01)

(58) Field of Classification Search
USPC ..... 381/310
See application file for complete search history.

(56) References Cited

U.S. PATENT DOCUMENTS

| | | | | |
|---|---|---|---|---|
| 9,122,707 | B2 | 9/2015 | Wither et al. | |
| 9,154,896 | B2 | 10/2015 | Mahabub et al. | |
| 2005/0222844 | A1 | 10/2005 | Kawahara et al. | |
| 2009/0052703 | A1 | 2/2009 | Hammershoi | |
| 2012/0266067 | A1 | 10/2012 | Armstrong et al. | |
| 2013/0142338 | A1 | 6/2013 | Chang et al. | |
| 2013/0236040 | A1* | 9/2013 | Crawford | H04S 7/304 381/310 |
| 2016/0112820 | A1 | 4/2016 | Yoo et al. | |
| 2016/0134988 | A1 | 5/2016 | Gorzel et al. | |

OTHER PUBLICATIONS

"3D Audio Spatialization", https://web.archive.org/web/20151229044152/https:/developer.oculus.com/documentation/audiosdk/latest/concepts/audio-intro-spatialization/, Published on: Dec. 29, 2015, 5 pages.

"Spatial sound", https://developer.microsoft.com/en-us/windows/mixed-reality/spatial_sound, Retrieved on: Jun. 6, 2017, 4 pages.

Heller, et al., "AudioScope: Smartphones as Directional Microphones in Mobile Audio Augmented Reality Systems", In Proceedings of the 33rd Annual ACM Conference on Human Factors in Computing Systems, Apr. 18, 2015, pp. 949-952.

Heller, et al., "Simplifying orientation measurement for mobile audio augmented reality applications", In Proceedings of the SIGCHI Conference on Human Factors in Computing Systems, Apr. 26, 2014, pp. 615-624.

Ranjan, et al., "Natural listening over headphones in augmented reality using adaptive filtering techniques", In Journal of IEEE/ACM Transactions on Audio, Speech and Language Processing, vol. 23, Issue 11, Nov. 2015, pp. 1988-2002.

Langlotz, et al., "Audio stickies: visually-guided spatial audio annotations on a mobile augmented reality platform", In Proceedings of the 25th Australian Computer-Human Interaction Conference: Augmentation, Application, Innovation, Collaboration, Nov. 25, 2013, pp. 545-554.

* cited by examiner

```
Float function ProcessOcclusion{
      // Default is unoccluded
      "Final Occlusion Ratio" = 0;


      for each Application in List of Applications
      {
            "Direct Path Occlusion" = User to Application Direct Path is Occluded

            if "Direct Path Occlusion"+
            {

            "Direct Path History" = Filter "User Location History" for Direct Path
            View of Application;

            }

            if (Direct Path Occlusion)
            {
                  "Final Occlusion Ratio" = 0.5;
            }

            If (Indirect Path Occlusion)
            {
                  "Final Occlusion Ratio" += 0.5
            }
      }
      Update "User Location History" with Current User Position;

      return "Final Occlusion Ratio";
}
```

FIG. 4A

```
get current listener location
for each tracked source
  Raycast(Listener, Source) to check for occlusion
  if occluded
    search through listener history for indirect paths
      search through per-source path history for closest visible sample
      if not found
          search for closest global history sample with visibility to a cached path to
source
      if path found
          store new path in per-source listener history
      store occlusion evaluation result (perceived direction, number of hops, total path
      distance)
```

FIG. 4B

SYSTEM FOR LOCALIZING CHANNEL-BASED AUDIO FROM NON-SPATIAL-AWARE APPLICATIONS INTO 3D MIXED OR VIRTUAL REALITY SPACE

CROSS-REFERENCE TO RELATED APPLICATIONS

This application claims the benefit of, and priority to U.S. Provisional Patent Application Ser. No. 62/479,157 filed on Mar. 30, 2017 and entitled "System for Localizing channel-Based Audio from Non-Spatial-Aware Application into 3D Mixed or Virtual Reality Space," which application is expressly incorporated herein by reference in its entirety.

BACKGROUND

Background and Relevant Art

Mixed reality (MR) encompasses the concept of merging real and virtual objects. The real and virtual objects can interact with each other in real time. For example, virtual objects can be projected into a user's view of a real world environment. Alternatively, real objects can be projected into a user's view of a virtual world environment. Augmented reality (AR) provides a live view of a physical real world environment (which may be viewed directly through transparent viewing elements, or indirectly through a projection of the physical real world environment) along with augmentation of the real world with additional virtual elements (or even real world elements existing in a different environment) such as sound, video, images, informative text, or other data. The technology functions by enhancing one's current perception of reality with additional information.

By contrast, virtual reality replaces the real world with a simulated one.

In augmented reality and mixed reality environments, it may be desirable to have real-world and virtual elements interact with each other in realistic ways. However, this can be difficult when mixing existing technologies with augmented reality and mixed reality technologies. For example, it may be desirable to display an application windows in a mixed reality environment. However, application windows are typically implemented by applications that were not originally designed for use in mixed reality environments. Thus, rendering of audio and/or visual elements of an application window may seem unrealistic when rendered in a mixed reality environment. For example, a user in the mixed reality environment may view the application window in one direction, but perceive sound from the application window in a different direction.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One embodiment illustrated herein includes a method of rendering audio for applications implemented in an MR or AR system, in a 3D environment. The method includes determining a location of a user device in the 3D environment. The method further includes accessing a set of spatial mapping data to obtain spatial mapping data for the determined location. The spatial mapping data includes spatial mapping of free-space points in the 3D environment. Data for each free-space point includes data related to audio characteristics at that free-space point. The spatial mapping data is based on data provided by users in the 3D environment. The method further includes applying the spatial mapping data for the determined location to one or more acoustic simulation filters. The method further includes using the one or more acoustic simulation filters with the spatial mapping data applied, rendering audio output for one or more applications implemented in the MR or AR system to a user.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which:

FIG. 2 illustrates a computer system architecture that is capable of converting the audio output from one or more non-spatial-aware acoustic volumetric applications into 3D audio based on the 3D environment a user is currently in;

FIG. 4A illustrates an example of machine executable instructions that the environmentally-based spatial analysis engine may execute to determine an occlusion control parameter for generating an occlusion filter;

FIG. 4B illustrates an example of alternative machine executable instructions that the environmentally-based spatial analysis engine may execute to determine various filter parameters;

FIG. 6A illustrates a panoramic photo of a room that a user is currently in;

FIG. 7 illustrates a method of converting audio data from non-spatially aware applications to 3D audio based on the 3D environment that a user is currently in.

DETAILED DESCRIPTION

Figure 1:
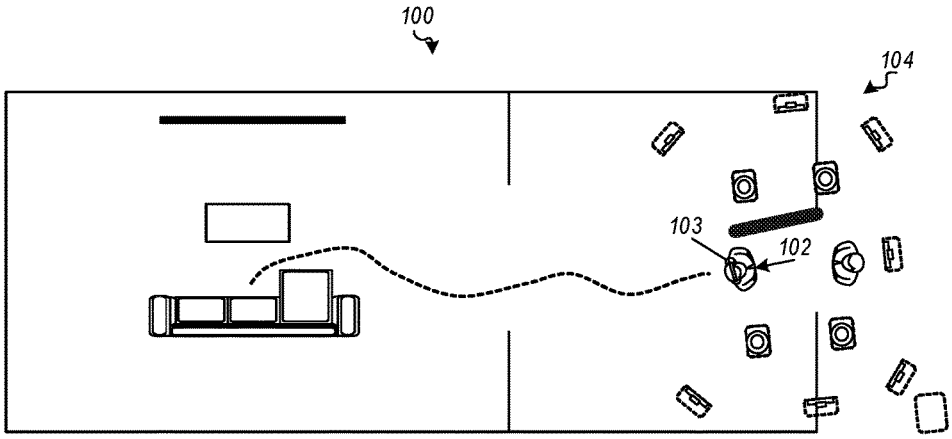
FIG. 1 illustrates a 3D environment in which a user is listening to audio from a non-spatially aware application.

Embodiments illustrated herein may include a specialized computer operating system architecture implemented on a user device, such as a MR or AR headset. The computer system architecture includes an audio mixing engine. The computer system architecture further includes a shell (i.e., a user interface used for accessing an operating system's services) configured to include information related to one or more acoustic volumetric applications. The computer system architecture further includes an environmentally-based spatial analysis engine coupled to the shell and configured to receive the information related to each of the list of the acoustic volumetric applications from the shell. The environmentally-based spatial analysis engine is further configured to receive spatial mapping data of an environment. The environmentally-based spatial analysis engine is further configured to receive present spatial data of a user. The environmentally-based spatial analysis engine is further configured to create (which may include supplying parameters, such as coefficients, to configurable filters) one or more acoustic simulation filters based on the information related to the one or more acoustic volumetric applications, the spatial mapping data of the environment, and the present spatial data of the user. The audio mixing engine is configured to receive audio data from each of the one or more acoustic volumetric applications and to apply the one or more acoustic simulation filters to the audio data transforming the audio data from the non-spatially aware audio into 3D audio.

Existing computer operating systems receiving audio data from non-spatially aware applications are not capable of reconstructing flat audio into 3D audio based on the user's 3D environment. As such, when users move in the 3D environment, they are listening to the same simple non-spatially-aware audio. For example, moving closer to or further from a source of the acoustic volumetric application, or turning one's head at an angle may have no effect on the audio emitting from the non-spatially aware applications.

Embodiments illustrated herein can improve over existing systems by causing the audio from an application to sound like it is coming from the location of the application (as placed in a VR, AR, or MR environment), rather than traditional channel-based, "inside your head" audio. This means that moving closer to the application in a 3D environment will make the audio sound louder, sometimes with less room reflections. Moving away will make the sound from the application softer and sometimes include more diffuse reverberation. When a user turns their head, the application's audio will sound like it is coming from the location it originated, to the left or right or behind the user's head.

Additionally or alternatively, embodiments may improve existing systems by including information about the environment in which a user is situated. This information may be collected over time from the user and/or other users using various 3D systems in the environment. Audio played for the user can be dependent on the information about the environment. Thus for example, audio reflections, audio absorptions, and the like can be simulated based on the information about the environment. This can result in a more realistic experience for a user using devices implemented using principles illustrated herein.

Four components are illustrated herein, in some embodiments, as will be illustrated below: The application playing audio, the shell, the audio stack, and the head tracking system. As noted above, the application is not spatially aware, and thus does not know where in 3D space it is located. However, the shell contains the application's location information. The application is playing channel-based audio, which is sent to the audio stack for it to be played by a device's speakers. The shell will transfer the application's location in 3D space to the audio stack. The shell may also transfer the application window's size and/or direction it is facing (the normal vector). The audio stack will now contain the application's spatial location, window size/orientation, and the channel-based audio data.

To make the location data useful, the audio stack relies on the head tracker's head tracking functionality. In some embodiments, every audio frame (i.e., for every audio sample), the audio stack queries the head tracker for the current location of the user. It then uses this information to update where in space the application is located, with respect to the current user location. This will change as the user moves throughout a 3D environment, but this process will keep the location up-to-date.

Now that the audio stack has the real-time application location information in relation to the user, and the audio that the application is emitting, it can combine both pieces of information and send the audio to a head-related transfer function (HRTF) processing engine (such as the Microsoft HRTF XAPO, available from Microsoft Corporation, of Redmond, Wash.) in real time. The result is that, without the application needing to update any of its code, audio that the application plays will sound like it is coming from the location where the application has been placed in a 3D environment, such as a MR environment.

Details are now illustrated.

FIG. 1 illustrates an environment 100 in which a user 102 is listening to audio from a non-spatially aware sound source, which in this example, is a headset 103 coupled to a music player in a virtual or real environment. In some embodiments, the headset 103 may be a VR or MR headset. When the user 102 is moving with the headset on, the sound follows the user 102 because the headset is perceived to be multiple stereo speakers 104 following the user 102. The headset 103 works well when the user 102 is listening to music on a bus, but fails to reflect a 3D environment when a user is in a mixed reality or a virtual reality 3D environment and is listening to a sound emitting from a non-spatially aware sound source in the 3D environment. For example, when the user moves out of their living room and answers the door, the sound from their headset continues to play at the same volume. Existing computer systems do not change the audio data received from a non-spatially aware acoustic volumetric application as the distance between the user and the acoustic volumetric application changes. Similar to the music player that a user uses to listen to music through headphones, the sound from the acoustic volumetric application would follow the user no matter where the user goes. Contrary to this phenomenon, in real life, when a person moves away from a real sound source (e.g., a party room), the sound (e.g., the party music and people's conversations) would fade as the distance between the person and the party room becomes further. Additionally, when the person walks out of the party room and shuts the door of the party room, the sound coming from the party room would be occluded. Furthermore, the magnitude of the volume of the sound from the party room heard after shutting the door would depend on the construction materials of the walls and the door.

Embodiments herein can convert flat audio data from one or more non-spatially aware acoustic volumetric applications into 3D audio in real time based on the location of the user and the location of the acoustic volumetric applications in the 3D environment, such that a user may enjoy the 3D audio effects even though the acoustic volumetric applications themselves may not be spatially aware.

Users in a VR, AR or MR 3D environment, can add applications to the environment. For example, in a VR environment, a user can open and place an application at a location in the virtual 3D environment. In an AR or MR 3D environment, a user can place a virtual application, virtually, in a physical real world location. A user may use an AR or MR headset, which allows the user to see both real world and virtual world objects. An application can be placed, as a virtual object, corresponding with a real world location. Thus, visually, the virtual applications will seem as if they are part of the physical real world environment. Embodiments illustrated herein can also cause the virtually placed applications to seem as if they are part of the real world 3D environment from an audio perspective as well.

Figure 2:
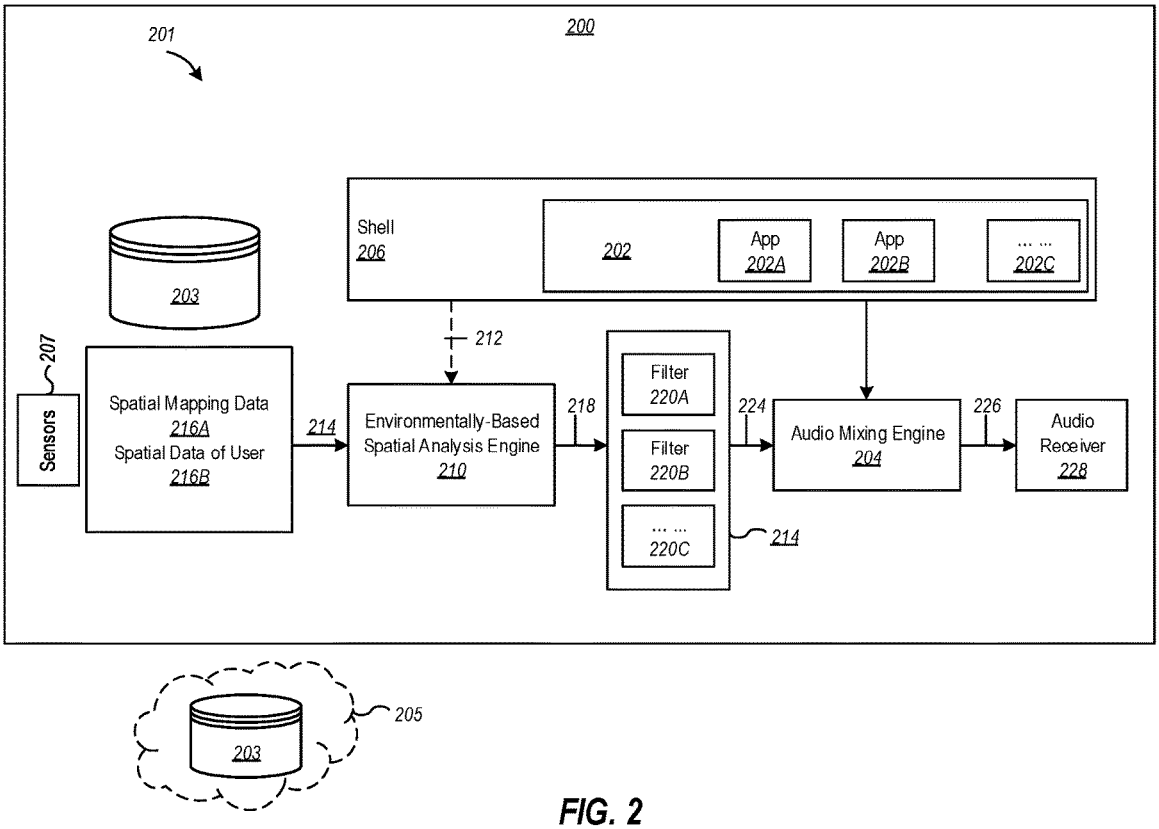

FIG. 2 illustrates a system 200 (such as the headset 103) and a computer system architecture 201 that is capable of converting the audio output from one or more non-spatial-aware acoustic volumetric applications into 3D audio based on the 3D environment a user is currently in. The computer system architecture 201 includes an audio mixing engine 204, a shell 206 configured to hosts applications 202, and therefore generates the spatial location information on behalf of the applications 202, and an environmentally-based spatial analysis engine 210 coupled to the shell and configured to receive as illustrated at 212, information related one or more acoustic volumetric applications 202 from the shell 206, to receive, as illustrated at 214, spatial mapping data 216A (which maps characteristics of an environment) and present spatial data of a user 216B, and to create, as illustrated at 218, one or more acoustic simulation filters 220 based on the information related to the one or more acoustic volumetric applications 202, the spatial mapping data 216A of the environment, and the present spatial data of the user 216B. The audio mixing engine 204 is configured to receive audio data from the acoustic volumetric applications, as illustrated at 222 and to apply, as illustrated at 224, the one or more acoustic simulation filters 220 to the audio data transforming the non-spatially aware audio from the applications 202 into the 3D audio and output, as illustrated at 226, the 3D audio to an audio receiver 228 (e.g., audio in a headset).

The shell 206 persists a variety of pieces of information related to each of the acoustic volumetric applications 202, such as the spatial anchors and the functionalities of each of the applications 202. A spatial anchor represents a point of location in an environment that the system would keep track of over time. For example, the shell 206 may track the location of applications 202 virtually located in a 3D environment. The shell 206 may alternatively or additionally track the orientation of applications 202. The shell 206 may alternatively or additionally persist information such as the function of the applications 202. For example, the shell 206 may track whether an application is a movie application, a video conferencing application, a web application, a productivity application (such as word processing or spreadsheets), etc. The shell 206 may additionally or alternatively track the display size of applications. Etc.

The shell 206 sends, as illustrated at 212, information related to each of the acoustic applications 202 including e.g., the spatial anchors, the functionalities of each of the applications 202, the display size of the application, or other information to the environmentally-based spatial analysis engine 210. The shell 206 also may decide which applications are to be spatialized. The shell 206 may also prioritize each of the one or more applications 202. The shell 206 sends, as illustrated at 212, these decisions to the environmentally-based spatial analysis engine 210. Audio output to a user can be adjusted on any one or more of these inputs. For example, for a movie application, embodiments may create a surround sound experience.

A user may be wearing a sensing device, such as the head tracker in the headset 103 described above, which include sensors 207 which sense the spatial data of the user 216B and are able to help create at least some of the spatial mapping data 216A of the 3D environment that the user is in. For example, the sensing device may include one or more imaging sensors collecting imaging data of the 3D environment (e.g., taking 2D pictures). As will be illustrated in more detail below, mapping the 3D environment can be used to more accurately reproduce audio from the applications 202 as if the audio were truly being emitted in the 3D environment and interacting with the elements of the 3D environment.

The sensing device may also include other sensors 207 to collect the present spatial data of the user 216B, movements of the user, acceleration of the user, etc. For example, the sensing device may include one or more distance sensors that sense the distance between the user's relative position and some other object in the 3D environment, such as the distance between the user's head and the floor, the ceiling, and/or each of the walls of the room. This may be done, for example, by collecting 3D imaging data. Alternatively or additionally, this may be done by sending signals and detecting the time it takes for the signals to be reflected back. In some embodiments, the strength of the reflection may additionally or alternatively be used to detect audio absorption characteristics of objects (including: barrier such as walls, floors, and ceilings; furniture; or other objects) in the 3D environment. In some embodiments, the sensors 207 may include spectrographic sensors, or other sensors that can be used to determine density, thickness, texture, and/or other characteristics of objects in the 3D environment. The sensing device may also include a GPS or other positional tracking sensor to sense the absolute position of the user. The sensing device may track head movements using gyroscopes, tilt sensors, and/or the like.

The sensing device may also track and/or compute information related to a user turning their head, changing directions, accelerating, moving at some speed, etc. The spatial data of a user 216B may also include a change of spatial data of the user. The change of spatial data of a user may include a change of the user's location. The sensing device, in some embodiments, sends the present spatial data of the user 216B and the spatial mapping data 216A of the 3D environment to the environmentally-based spatial analysis engine 210 substantially in real time.

The environmentally-based spatial analysis engine 210 receives, as illustrated at 212, information about each of the one or more applications 202 from the shell 206 and also receives the present spatial data of a user 216B and the spatial mapping data 216A of the 3D environment that the user is in from the sensing device that the user is wearing. The environmentally-based spatial analysis engine 210 analyzes the information received from the shell 206 and data received from the user's sensing device, then creates one or more acoustic simulation filters 220, and sends the parameters (e.g., filter coefficients) of each of the acoustic simulation filters 220 to the audio mixing engine 204. For example, the environmentally-based spatial analysis engine 210 may analyze the direct distance between the user's location and each of the applications 202 and generate one or more filters based on the reverberation time between the user and the location of each of the applications 202. Note that generating filters may include, in some embodiments, applying filter coefficients or other parameters to existing configurable filters. In some embodiments, reverberation time may be based on the amount of time for reverberation to attenuate by 60 dB, also known as RT60. In another example, the environmentally-based spatial analysis engine 210 may compute an audio arrival direction, total audio path distance and other acoustic parameters which then lead to the selection of head-related transfer function (HRTF) applied to process an audio output simulation.

The audio mixing engine 204 may receive audio data from one or more acoustic volumetric applications 202, receive the parameters of each of the one or more acoustic simulation filters 220 generated from the environmentally-based spatial analysis engine 210, and apply the parameters of one or more acoustic simulation filters 220, transforming the original non-spatially aware audio data received from the applications 202 to 3D audio, reflecting the 3D environment in which the user is interacting. As illustrated in FIG. 2, the audio mixing engine 204 receives audio data from applications 202, including application 202A and application 202B. The ellipsis 202C represents that the list of applications 202 may include a different number (including one) of applications sending audio data to the audio mixing engine 204. The list of acoustic volumetric applications 202 may include, for example, a music player, video game system, a video player, a conference call system and/or other applications.

The one or more acoustic simulation filters 220 may include, for example, a reverberation time filter reflecting the distance between the present location of the user and the location of an application, an occlusion filter with a specified occlusion control parameter when there is no direct path between the present location of the user and an application, and/or other filters. The one or more acoustic simulation filters 220 may alternatively or additionally include filters with parameters related to echo, delay, decay, damping, attenuation, specific frequency filtering, etc. The parameters may be set by user settings, generated by the environmentally-based spatial analysis engine 210 based on data received from the user's sensing device, and/or generated based on stored information about the user, the environment, or other information.

The one or more acoustic simulation filters 220 may alternatively or additionally include a filter to smooth a change of sound received from the acoustic volumetric applications. The change of sound may be caused by conditions that should result in a sudden and/or unpleasant change of a perceived sound direction. The change of sound may alternatively or additionally be caused by aberrant conditions that should result in a change of a perceived sound volume intensity. However, the environmentally-based spatial analysis engine 210 may include and/or generate a filter to smooth changes from sudden changes to make the user experience more pleasant, or in some cases more realistic.

However, note that in some other examples, sudden sound changes may be wholly appropriate for rendering sound to a user. For example, a user may suddenly turn their head, such that the perceived sound might also ordinarily be changed rapidly to account for the sudden change in the user's head position. By using other sensor information, such as sensor information on a user headset 103, embodiments can confirm that indeed the user themselves initiated the sudden movement, and thus smoothing would not be applied at all or in the same way as for other sudden sound changes.

In another example, when a user leaves a room and shuts a door of the room, the perceived sound source may disappear rapidly. The environmentally-based spatial analysis engine 210 may also generate a filter smoothing what might otherwise be a sudden volume change. However, if other sensors can confirm that the door actually shut, embodiments may decline to apply filtering in favor of a more realistic experience.

Similarly, when a user walks in a loud 3D environment, the environmentally-based spatial analysis engine 210 may also generate a filter smoothing the sudden increase in volume to a more gradual increase in volume perceived by the user.

Smoothing involves gradually changing the sound characteristics in response to a sudden condition. Thus, for example, a sudden door closure will result in sound volume being more gradually reduced. Similarly, sudden directional changes by the user, when smoothed, will result in more gradual changes in the perceived sound transmitted to the user.

Note that in some embodiments, this smoothing may be used to correct for inaccuracies in mapping a 3D environment. In particular, as will be illustrated below, in some cases, free-space leaks may occur when mapping of a 3D environment detects a hole through a wall where none exists. This may be caused by the presence of reflective surfaces which confuse optical sensors, incomplete mapping of the 3D environment, or for other reasons. This may cause the audio mixing engine to attempt to render sound through the free-space leaks as if they were un-occluded. However, this would be an inaccurate rendering of the audio. By using smoothing techniques in these situations, the effect of the free-space leaks may be minimized, particularly when continued mapping results in eliminating the free-space leaks. For example, while the audio mixing engine 204 may gradually begin to generate audio based on the presence of a free-space leak, later, the free-space leak may be corrected by the environment being correctly mapped with respect to the free-space leak before the volume of the audio is increased to a level sufficient to create a perception by the user of a hole in a wall, where none exists.

Note that the shell 206, the environmentally-based spatial analysis engine 210, and the audio mixing engine 204 may be included in an operating system implemented on a device.

Figure 3A:
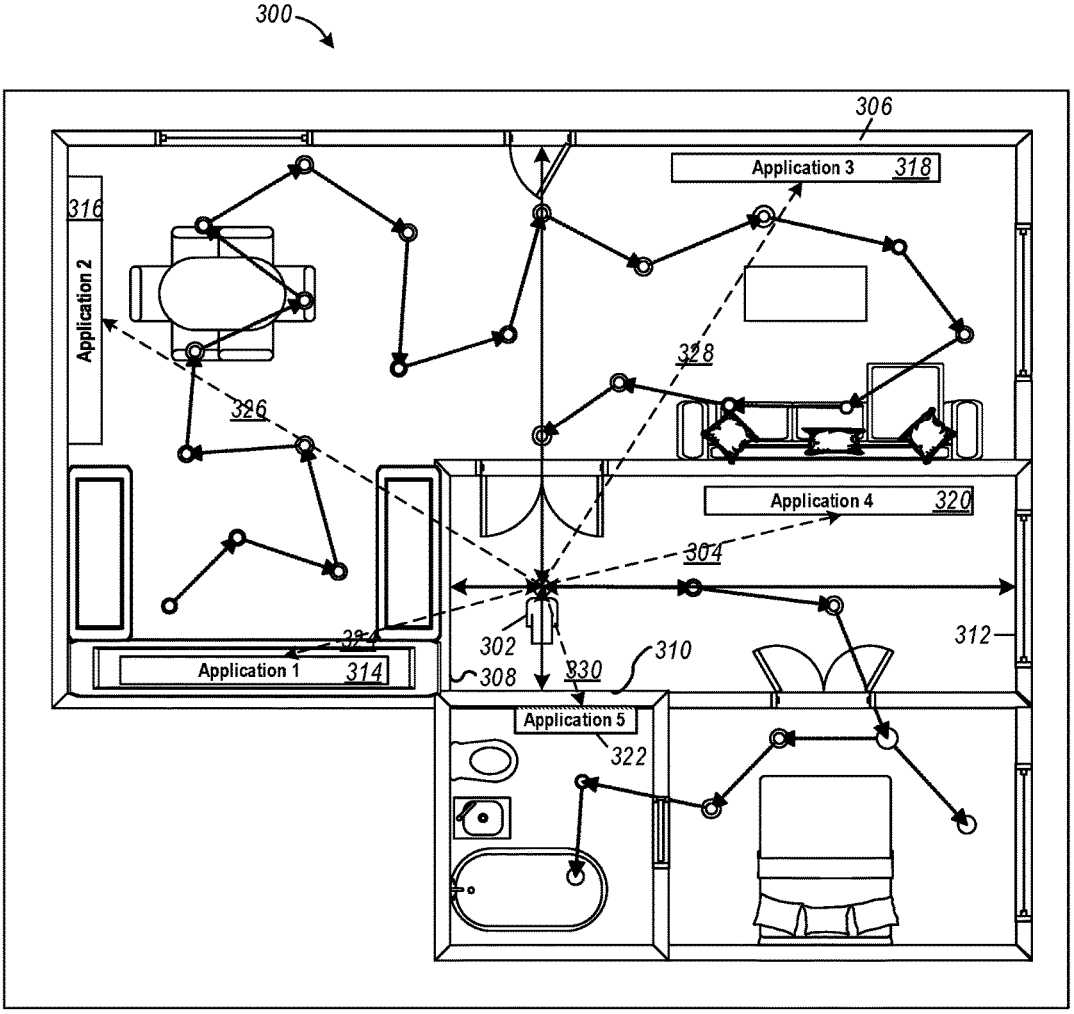
FIG. 3A illustrates a 3D environment in which a user's sensing device collects spatial mapping data and sends the collected spatial mapping data to the environmentally-based spatial analysis engine of a computer system having a computer system architecture illustrated in FIG. 2.

FIG. 3A illustrates a 3D environment 300 in which a user's sensing device collects the spatial mapping data 216A and the spatial data of a user 216B and sends the collected data to the environmentally-based spatial analysis engine 210 of a computer system having a computer system architecture 201 illustrated in FIG. 2. When there is a direct path between the user 302 and an application (e.g., application 4 320), the environmentally-based spatial analysis engine 210 may simply analyze the distance 304 between the user and the application (e.g., application 4) and create a reverberation time filter based on the distance between the user and the application. The environmentally-based spatial analysis engine 210 may also analyze the distance between the user and each of the walls, including walls 306, 308, 310, and 312. Depending on the material of the walls, the environmentally-based spatial analysis engine 210 may also apply additional reverberation filter parameters based on the distance between the user and each of the walls 306-312. The environmentally-based spatial analysis engine 210 may also apply additional filters based on the distance between the user's head and the floor and/or ceiling of a room or space and/or the material of the flooring and the ceiling. The material of the walls, floor, ceilings, and furniture and the reverberation parameters may be input by the user. Alternatively, such information may also be obtained by having the user's sensing device send out testing signals and recording and analyzing the responding signals by the environmentally-based spatial analysis engine 210. Alternatively or additionally, algorithms (e.g. semantic labeling) on the sensing device will detect the materials around the users that can be used for acoustic analysis.

The spatial mapping data 216A of an environment received from the user's sensing device may be recorded by the environmentally-based spatial analysis engine 210, or other components, to generate metadata for various free-space points in the user's location history in the 3D environment. That is, as a user moves about a 3D environment, data will be collected at various free-space points that the user visits in the 3D environment. More particularly, the free-space points may be based on the location of the headset 103 in the 3D environment. One user's location history metadata may be accessed by other users in the same environment. The metadata for each of the free-space points in the user's location history may include a distance between a barrier in the environment and each of the free-space points. For example, as illustrated in FIG. 3A, the metadata for the free-space point where the user 302 is located may include the distances between the user 302 and the wall 308, the wall 310, the wall 312, and the wall 306, as well as ceilings, floors, furniture, or other physical objects. Alternatively or additionally, metadata for a free-space point may include reverberation characteristics at the point, or other data.

In one implementation, multiple users may share their location history metadata and the metadata generated by different users may be merged into an agglomeration of metadata and stored in the system architecture 201 or in another appropriate location. For example, in one implementation, the metadata may be stored in a networked cloud space that allows multiple users or systems to access the metadata. For example, FIG. 2 illustrates storage 203 which may be located at a local machine, such as a machine implemented in the headset 103 or in a cloud environment, such as the cloud environment 205 illustrated in FIG. 2.

The metadata for each of the free-space points in the metadata may also include the distance between the free-space point and each of the applications (or other audio emitters). For example, as illustrated in FIG. 3A, the metadata for the free-space point where the user 302 is located may also include the distances between the user 302 and application 1 314, application 2 316, application 3 318, application 4 320, and application 5 322. The metadata may alternatively or additionally include information of whether there is a direct path between each of the free-space points and each of the applications. For example, as illustrated in FIG. 3A, the metadata for the free-space point where the user 302 is located may also include information indicating that there is no direct path between the user 302 and application 1 314 (which is illustrated as a dashed line 324 linking the point of the user 302 and the location of the application 1 314). The metadata for the same free-space point may also include information indicating that there is no direct path between the user 302 and each of the applications 2, 3, and 5 (316, 318, and 322), which is also illustrated as dashed lines 326, 328, and 330 respectively linking the free-space point of the user 302 and each of the applications 2, 3, and 5 (316, 318, and 322).

In some embodiments, metadata from users' location history may be collected at a specified resolution expressed as a distance, such as 1 foot or 1 inch. The denser the user's location history that is collected, the more accurate the metadata that is available. For example, embodiments may be implemented with a resolution defining some distance that is allowable between collection of data points. If a data point has already been collected at a point within that distance, additional data points will not be collected. Note that the resolution may vary in different directions. For example, x and y directions may have one resolution, while z directions have a different resolution.

Note that embodiments may collect data using location history of one or several users. Indeed, several different users of different heights may provide the opportunity to collect data from location history that would not be possible if only a single user's location history were used.

Figure 3B:
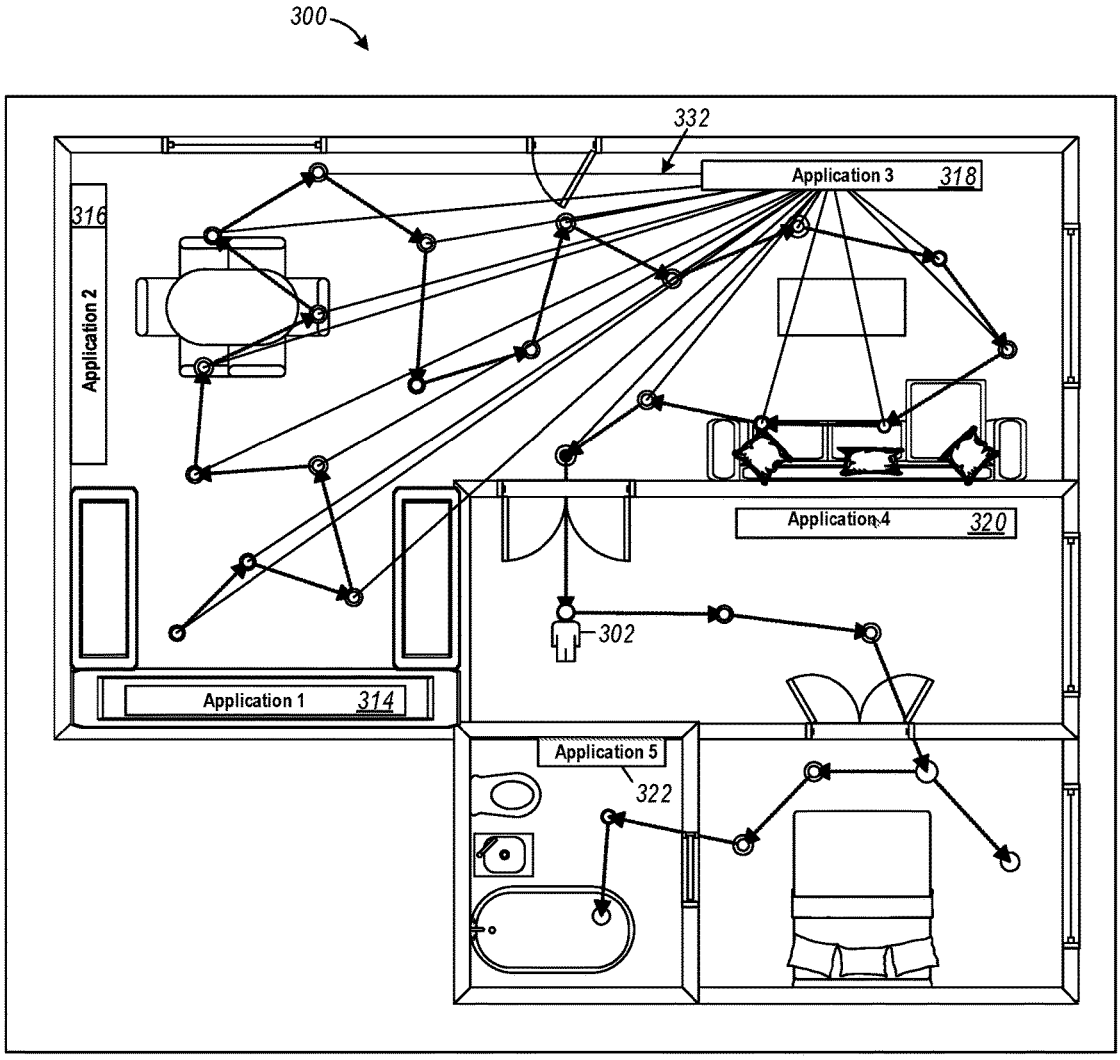
FIG. 3B illustrates a 3D environment in which the environmentally-based spatial analysis engine records each free-space point in the user location history as metadata.

The environmentally-based spatial analysis engine 210 may organize the metadata of one or more users' location history to be able to be used to identify direct free-space un-occluded paths between each location in the location history (or sets of locations). In particular, this can be used by the environmentally based spatial analysis engine 210 to identify free-space, un-occluded paths between points and applications. For example, FIG. 3B illustrates a 3D environment 300, in which various locations in the user's location history have a direct path to application 3 318 is shown linked to application 3 318 by a line 324. The lines 324 linking application 3 318 and some of the locations in the previous user's location history indicate that there are direct paths between those locations and application 3 318. The paths indicated by lines 332 are the "mapped free-space paths" to application 3 318. Similarly, the environmentally-based spatial analysis engine 210 may also include a set of the user's previous locations that have a direct path to application 1 314, application 2 316, application 4 320, and application 5 322. They are the mapped free-space paths to application 1 314, to application 2 316, to application 4 320, and to application 5 322. Note that the metadata may further be used to identify free-space paths when new applications are added to the 3D environment.

When there is no direct path from a user's location to an application, the environmentally-based spatial analysis engine 210 may simply dampen the sound emitted from the application based on the occlusions (e.g., walls or furniture) between the application and the user's location. Alternatively or additionally, the environmentally-based spatial analysis engine 210 may partially dampen the sound emitted from the application by creating an occlusion filter with a predetermined occlusion control parameter. The predetermined occlusion control parameter may be determined based on the construction materials of the wall, which may be input by a user or detected by the sensing device that the user wears. In another implementation, the environmentally-based spatial analysis engine 210 may further create a reverberation time filter based on the distance between the user's location and the application in addition to the occlusion filter with a predetermined occlusion ratio, such that when a user is on the other side of the wall from an application, not only does the wall partially occlude the sound from the application, but also the more remote the user's location is, the less volume of the sound the user may hear.

However, when there is no direct path, but an indirect path between a user and an application, simply applying an occlusion control parameter and/or reverberation time filter may not accurately reflect the 3D sound effect from the application that the user would perceive, because a sound diffracts and changes direction when it travels through obstacles. In one implementation, when there is no direct path between a user and an application, the environmentally-based spatial analysis engine 210 may further analyze the present spatial data of the user and the metadata of the 3D environment and determine whether there is an indirect path between the user and the application. An indirect path is one that can be taken in free-space around occlusions (such as walls) rather than through the occlusions. When an indirect path is found, the environmentally-based spatial analysis engine 210 may create a different or an additional filter to simulate the indirect path between the user and the application. There are many implementations that the environmentally-based spatial analysis engine 210 may implement to find an indirect path between a user and an application and to simulate the sound effect caused by the indirect path found.

Figure 3C:
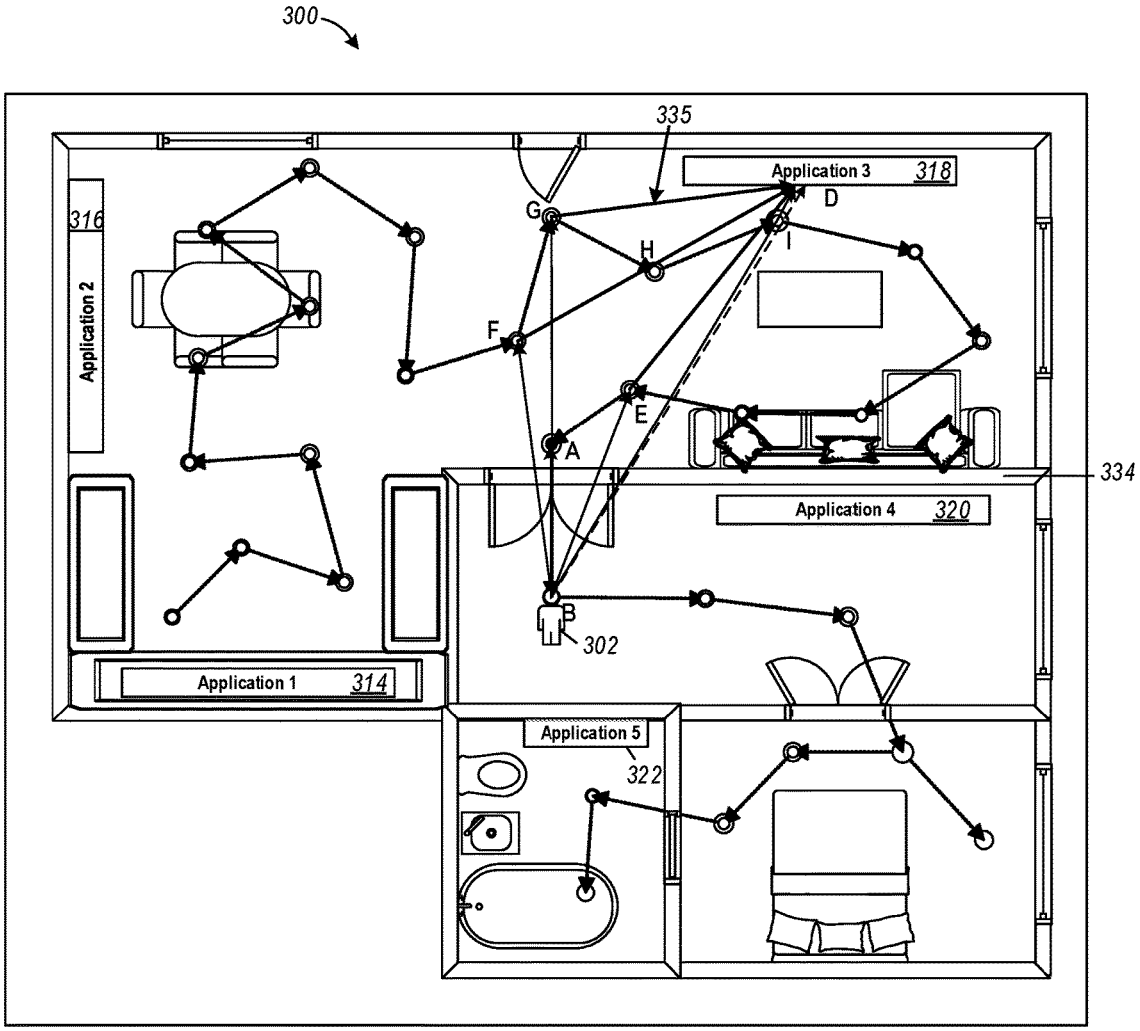
FIG. 3C illustrates a 3D environment in which the environmentally-based spatial analysis engine finds and selects an indirect path between the user's current location and the location of an application, when there is no direct path between the user and the application.

In one implementation, when the current spatial data of the user 216B and the spatial mapping data 216A reflect that there is no direct path between the user 302 and an application, the environmentally-based spatial analysis engine 210 may access the metadata including the mapped free-space paths to the application. For example, as illustrated in FIG. 3C, when the current spatial data of the user 216B and spatial mapping data 216A show that there is no direct path between the user 302 and application 3 318, the environmentally-based spatial analysis engine 210 may access the mapped free-space paths illustrated by lines 332 (illustrated in FIG. 3B) and determine if there are free path points in the user's location history from which there is a direct path to an application, such as in the illustrated example, application 3 318. As illustrated in FIG. 3B, in this case there are more than one free path points found from which there is a direct path to application 3 318. Then, based on the present spatial data of the user 216B, the environmentally-based spatial analysis engine 210 may determine whether there is a direct path between the user and each of these free path points found. Each of the locations from which there was a direct path to application 3 318 and also a direct path to the user are indicated by lines 335 including locations A, E, F, G, H and I. Among the locations A, E, F, G, H, and I (that have a direct path to application 3 318 and also a direct path to the user 302), the environmentally-based spatial analysis engine 210 may choose at least one of the paths to simulate the distance that the sound travels from application 3 318 to the user 302's location B. Among these paths, the shortest path is the path that goes through the closest location to the user's present location B. In one implementation, the environmentally-based spatial analysis engine 210 may select the shortest path between the present user location to each of the applications. For example, as illustrated in FIG. 3C, among the locations A, E, F, G, H, and I, location A is the closest to the user. The shortest path here is the path through location A. The environmentally-based spatial analysis engine 210 may select the path BAD as the path the sound travels, then calculate the distance of the path BAD, then generate a reverberation time filter based on the distance of the path BAD. The audio mixing engine 204 may apply the reverberation time filter generated based on the distance of the path BAD and output the filtered audio to the user's headset to reflect the 3D environment that the user is in. Additionally, the environmentally-based spatial analysis engine may further generate an occlusion filter with a predetermined occlusion control parameter in addition to the reverberation time filter. The occlusion control parameter may be determined based on the materials of the walls, which may be input by the user or detected by the sensing device that the user is wearing.

Figure 3D:
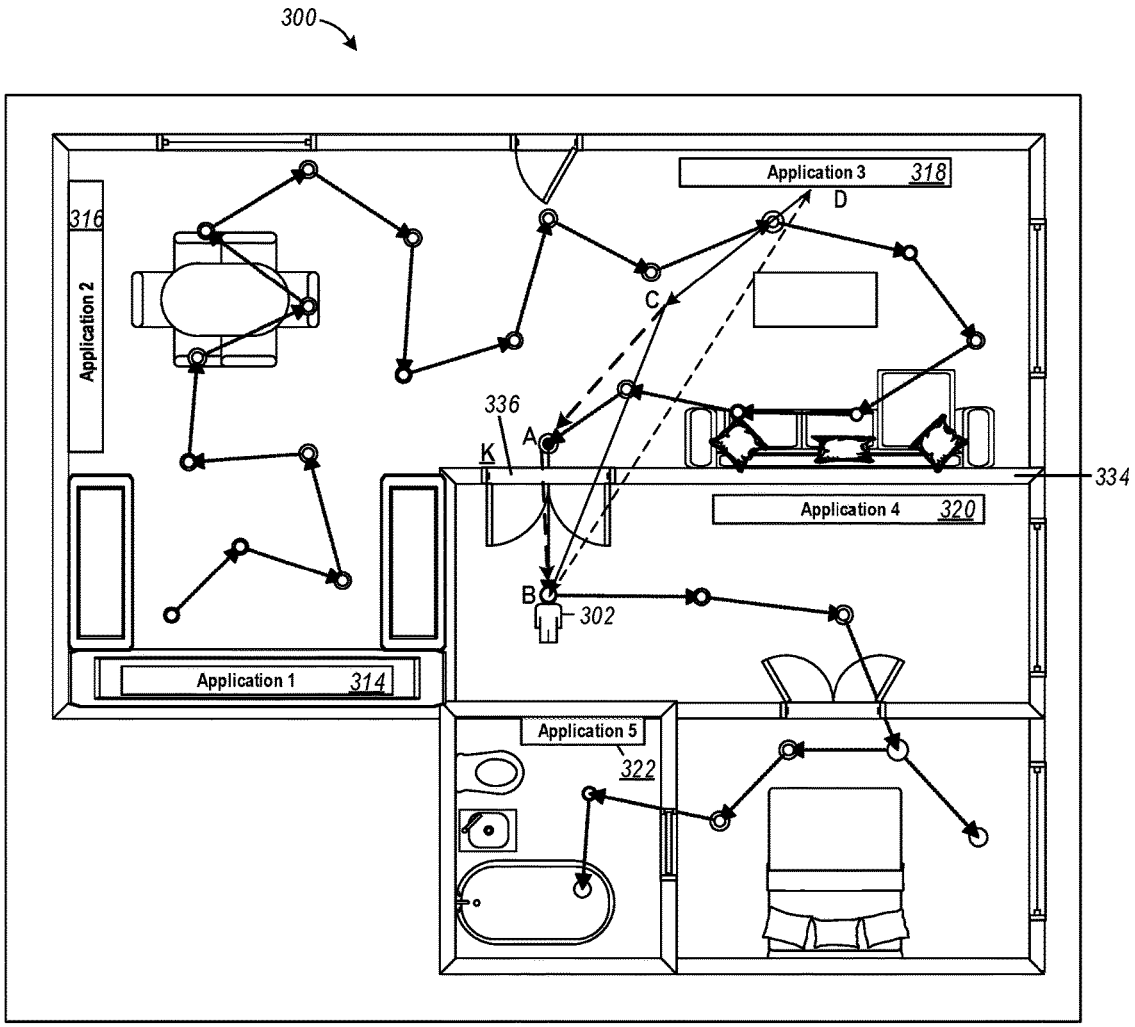
FIG. 3D illustrates a 3D environment in which the environmentally-based spatial analysis engine further optimize the indirect path between the user's current location and the location of application 3 (illustrated in FIG. 3C), when there is no direct path found.

FIG. 3D illustrates another implementation that further modifies the indirect path by the environmentally-based spatial analysis engine 210. As illustrated in FIG. 3D, there is a wall 334 between the user 302 and application 3 318. A door 336 is installed in the wall 334 between the points J and K. The point of the right edge of the door is location J. The point of the left edge of the door is location K. Between points J and K, point J is the closest point to the location of application 3 318. A sound emitted from application 3 318 travels and reaches the right edge of the door at location J first, then the sound diffracts. And, the user 302 located at location B would perceive the sound as coming from the direction of location J. One may draw a line from location B to location J. The line BJ would intersect with the line AD at the point C. In one modified implementation, the environmentally-based spatial analysis engine 210 may select the indirect path BCD and use the distance of the indirect path BCD to generate the reverberation time filter. Similarly, as mentioned above, the environmentally-based spatial analysis engine 210 may further include an occlusion filter with a predetermined occlusion control parameter in addition to the reverberation time filter generated based on the indirect path BCD selected.

There are many different implementations that the environmentally-based spatial analysis engine 210 may implement to generate an occlusion filter based on the metadata of each of the free-space points in the user's location history, the location of an application from the shell 206, and the spatial data of a user 216B and the spatial mapping data 216A from the sensing device that the user is using. In one implementation, generating an occlusion filter based on the distance between a user's present location and the location of an application may be achieved by the environmentally-based spatial analysis engine 210 executing the computer-executable instructions. In one embodiment, a computer readable storage device storing the computer-executable instructions may be coupled to or included in the environmentally-based spatial analysis engine 210.

The present spatial data of a user 216B may include, but are not limited to, the position of a user, the distance between the user and each of the barriers (e.g., walls, floor, and ceiling), the direction of the user's movement, the speed of the user's movement, and the head turning angle. The present spatial data of a user 216B may also include a change of the spatial data of the user. The change of spatial data of the user may include a change of the user's location. In response to a change of the user's location, the acoustic simulation filters may include a filter configured to transform the audio data by moving a perceived sound source of the acoustic volumetric application to another location.

Figure 3E:
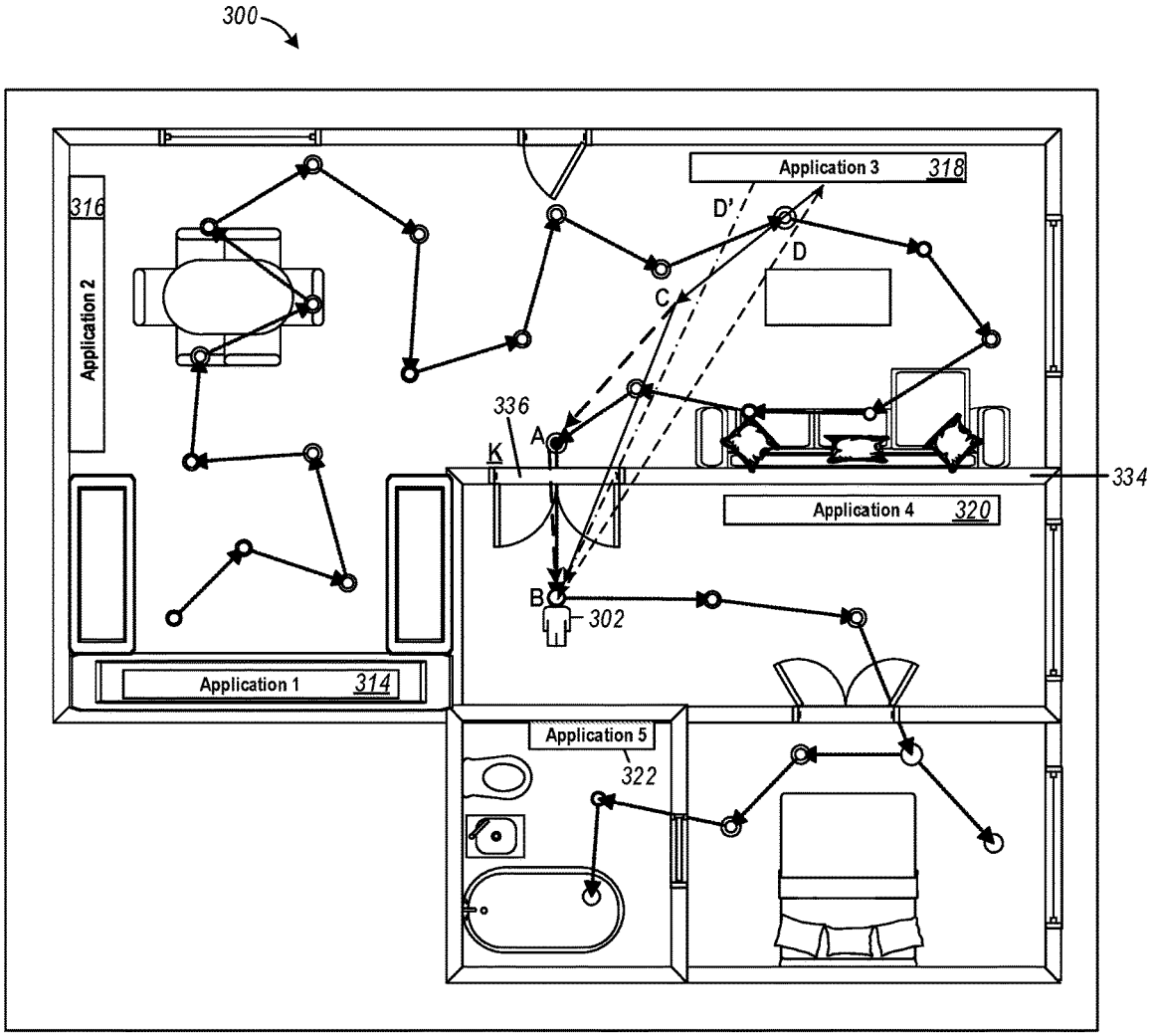
FIG. 3E illustrates a 3D environment in which the environmentally-based spatial analysis engine may change the perceived location of the source of the sound.

For example, as illustrated in FIG. 3E, when a user is located at location A, the sound from application 3 318 travels from location D directly to location A (the user's location); in contrast, when a user is located at location B, the sound from application 3 318 travels to the right edge of the door (location J) and diffracts to the user's location B. In one embodiment (illustrated in FIGS. 3C and 3D), the environmentally-based spatial analysis engine may simulate the indirect path of the sound traveling from application 3 318 to the user at location B as line DCB. The user 302 perceives that the sound comes from the direction CB, and that the distance between the user 302 and the sound source is the total distance of line CB and line DC. Therefore, the user actually perceives D' as the sound source of application 3 318. In a situation that the user moves from location A to location B, the perceived sound source of application 3 318 would move from location D to location D'.

FIG. 4A illustrates an example of a pseudo-code version of computer executable instructions that may be stored in a computer readable storage device coupled to the environmentally-based spatial analysis engine 210 for determining an occlusion control parameter of each of the applications and also updating the metadata of the current user's location in the user location history. As illustrated in FIG. 4A, for each of the applications 202, the environmentally-based spatial analysis engine 210 receives information indicating whether there is a direct path between the user and the application. If there is a direct path between the user and the application, there is no occlusion. If there is no direct path between the user and the application, a Boolean variable "Direct Path Occlusion" is set as true. If the variable "Direct Path Occlusion" is true, the environmentally-based spatial analysis engine 210 accesses the metadata database of "User Location History" and filters out the free-space points in the "User Location History" that have a direct path view of the application, then defines an array "Direct Path History" to include all of the filtered free-space points that have a direct path view of the application. Then, the environmentally-based spatial analysis engine 210 further filters the free-space points in the data structure "Direct Path History" to only include the free-space points that have a direct view from the user's present location. If there is no free-space point found that has a direct view from the user's present location, the array of "Direct Path History" would be empty (i.e., there is no indirect path found), and the environmentally-based spatial analysis engine 210 sets the value of a variable "Indirect Path Occlusion" as true. If there are free-space points found, the array of "Direct Path History" would not be empty, and the environmentally-based analysis engine 210 sets the value of "Indirect Path Occlusion" as false.

If the value of "Direct Path Occlusion" is true (i.e., there is no direct path between the user and the application), the environmentally-based spatial analysis engine sets the value of a variable "Final Occlusion Ratio" as 0.5 (or any appropriate predetermined ratio). If the value of "Indirect Path Occlusion" is true (i.e., there is no direct path or indirect path between the user and the application), the environmentally-based spatial analysis engine increases the value of the "Final Occlusion Ratio" by 0.5 (i.e., sets the "Final Occlusion Ratio" to 1.0 (0.5+0.5)). After repeating the above operations for each of the applications, the environmentally-based special analysis engine 210 updates the metadata database of the user's location history to include the current user position, and returns the "Final Occlusion Ratio" for each of the applications.

In an alternative embodiment, as illustrated in the pseudo-code version of computer executable instructions illustrated in FIG. 4B, The spatial analysis engine does not produce an "Occlusion Ratio" but instead produces perceptual acoustic parameters, arrival direction, number of "hops", total distance from listener to source etc., which are then used to control the filtering characteristics exhibited by the acoustic simulation filters 220 (see FIG. 2).

Figure 5A:
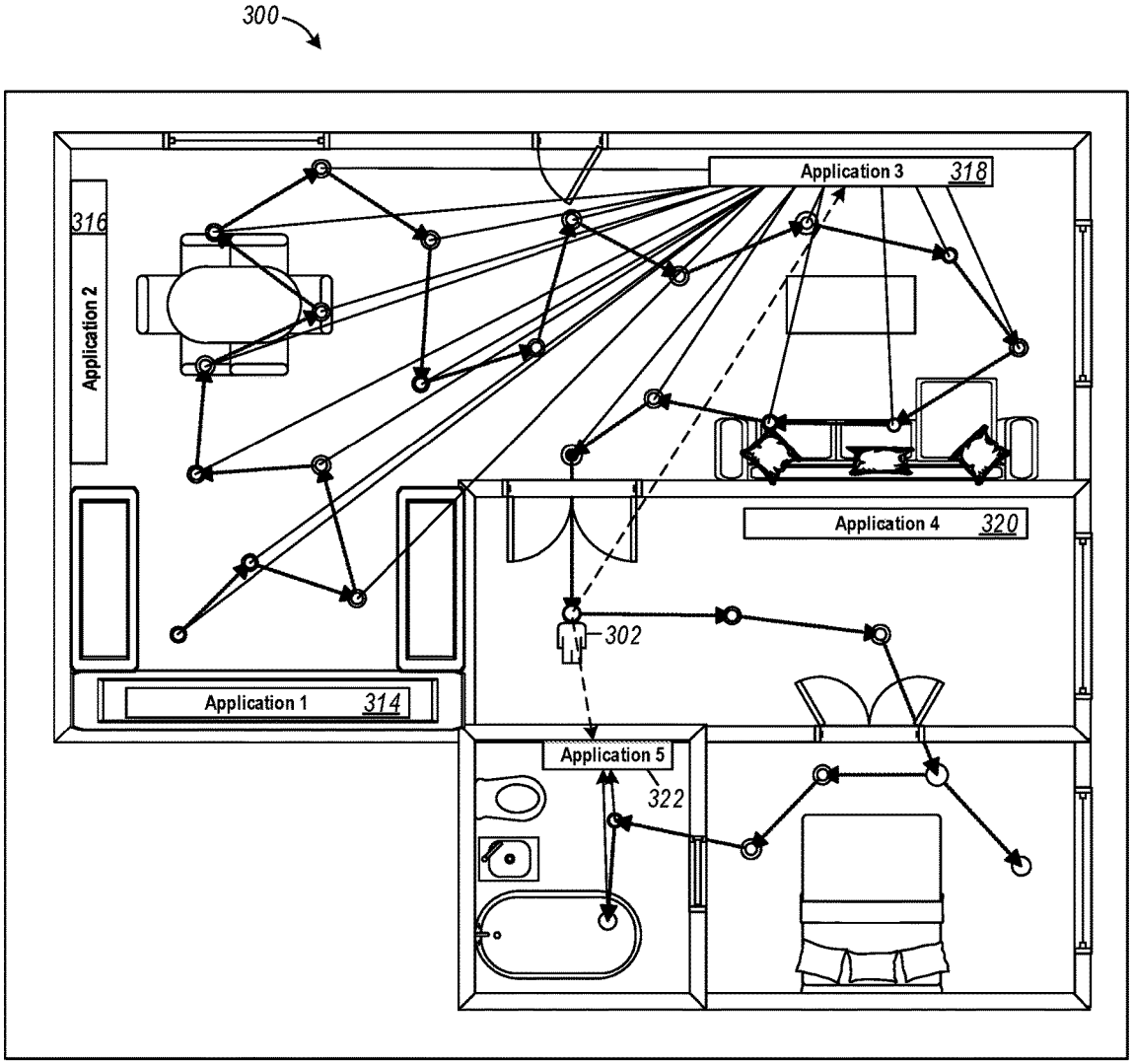
FIG. 5A illustrates a 3D environment further illustrating the execution of the machine executable instructions (illustrated in FIG. 4)
Figure 5B:
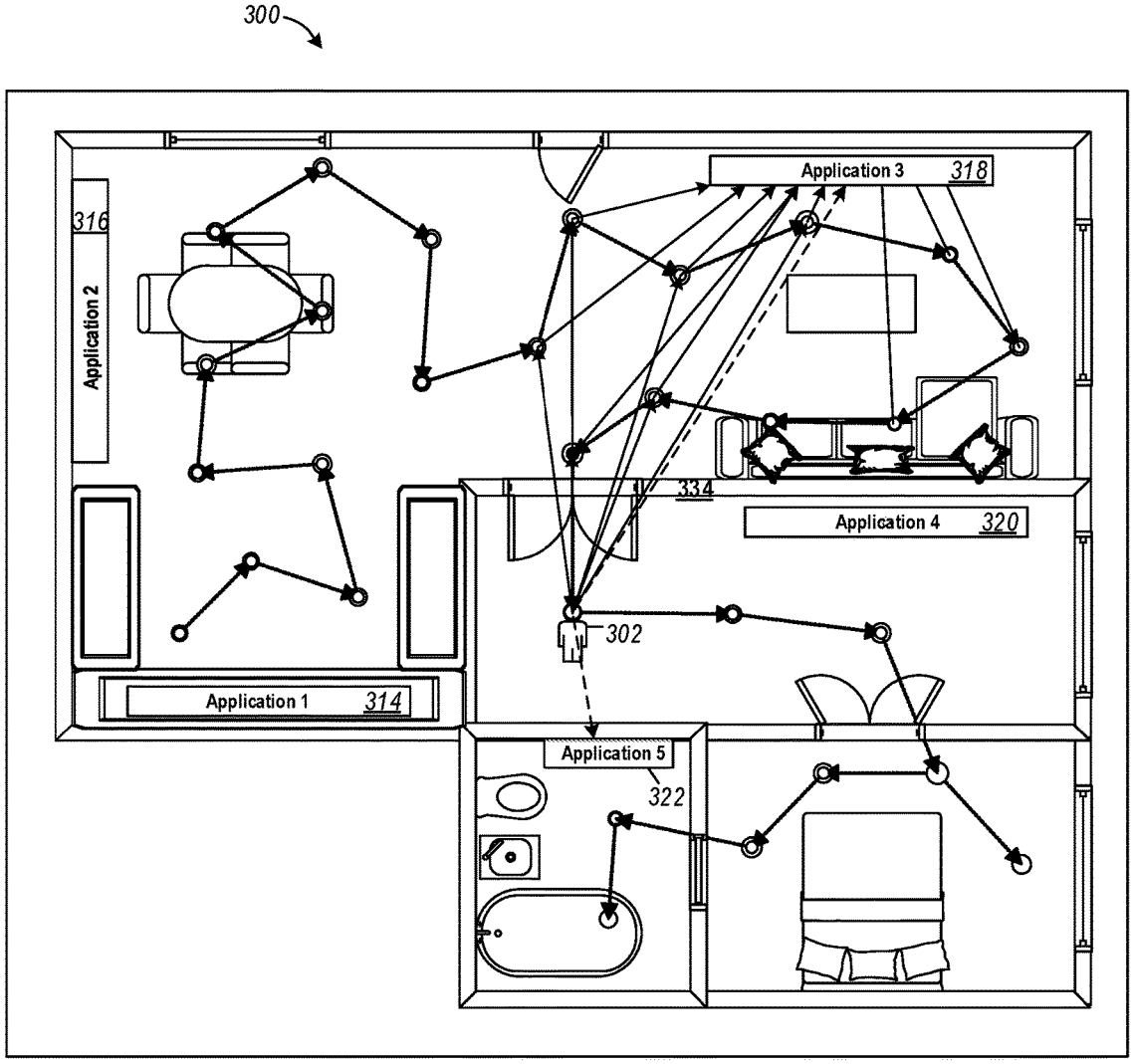
FIG. 5B illustrates a 3D environment further illustrating the execution of the machine executable instructions (illustrated in FIG. 4)

FIGS. 5A and 5B further illustrate the function of the computer executable instructions (illustrated in FIGS. 4A and 4B). Referring to FIG. 5A, going through the instructions in FIG. 4A, for each of the applications, the environmentally-based spatial analysis engine 210 detects whether there is a direct path between the user 302 and each of the applications. If there is no direct path between the user 302 and an application, the value of the variable "Direct Path Occlusion" is true. Using application 3 318 as an example, there is no direct path between the user 302 and the location of application 3 318. Therefore, the value of "direct path occlusion" is true, which is indicated by the dashed line linking location B (the present user's location) and location D (the location of application 3 318). If the value of "Direct Path Occlusion" is true, the environmentally-based spatial analysis engine 210 filters the metadata database of the "user location history" to include only the free path points from which the direct path view of application 3 was true. As illustrated in FIG. 5A, each of the free-space points that have a direct view to application 3 318 is linked with application 3 318 via a straight line. The information of each of these free-space points is stored in an array called "Direct Path History." Then, the environmentally-based spatial analysis engine further filters the array "Direct Path History" to only include the "user location history" from which a direct path view of the user is true. Referring to FIG. 5B, all the free-space points that are included in the further filtered array of "Direct Path History" are linked to the user's location via straight lines. Here, clearly, the "Direct Path History" is not empty, therefore, the "Indirect path occlusion" is false. However, since "direct path occlusion" is true, the "final occlusion ratio" is 0.5. Note, that using the code illustrated in FIG. 4B, rather than just an occlusion ratio, some embodiments may instead produce parameters for an indirect path, such as an adjusted arrival direction and total path distance for a modified perceived source location, etc.

For another example, using application 5 322 as an example, the value of "Direct Occlusion" is also true, because there is no direct path between the user 302 and the application 5 322, which is indicated with a dashed line linking the user 302 and application 5 322. In this case, the environmentally-based spatial analysis engine 210 filters the free-space points in the user location history to find the free-space points from which there is a direct view to the application 5 322. Here, there are only two free path points which have a direct view to the application 5 322, which are indicated with straight lines linking the two free-space points and the location of the application 5 322. Then, the environmentally-based spatial analysis engine 210 further filters the two free-space points and determines whether each of them has a direct view to the current user's location. In this case, none of the free-space points has a direct view to the current user's location. Therefore, unlike the previous example of application 3 318, the value of "Indirect Path Occlusion" to the application 5 322 is true. Because the value of "Direct Path Occlusion" and "Indirect Path Occlusion" are both true here, the value of the "final occlusion ratio" is 1.0 (0.5+0.5). Alternatively or additionally, Full occlusion parameters with no indirect path are sent to the environmentally-based spatial analysis engine 210. Such parameters may include a perceived direction that is the same as the source (i.e., application 5 322) and a flag set to indicate no direct or indirect free-space path exists. The environmentally-based spatial analysis engine 210 may then simulate "through the wall dampening" using a low-pass filter.

The metadata for each of the free-space points in the user location history may include the distance between each free-space point and an application and whether there is a direct path between each of the free-space points and an application. The metadata may also include the "final occlusion ratio" for each of the applications. Furthermore, the metadata for each of the free-space points may also include reverberation parameters for each of the applications. The parameters may be related to the construction materials and/or the size of the 3D environment, etc. The parameters may include, but are not limited to, echo, delay, decay, damping, attenuation, specific frequency filtering, etc. The parameters may be preset by user settings, or detected by the sensing device of a user. In one implementation, the environmentally-based spatial analysis engine 210 may request that the sensing device send out a test signal and detect the reflection of the test signal determining the construction materials of the 3D environment.

Figure 6A:
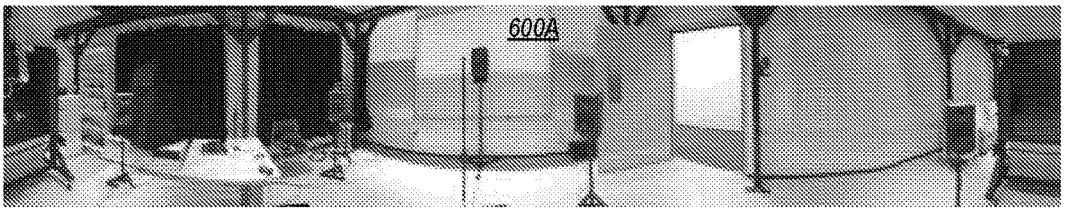
Figure 6B:
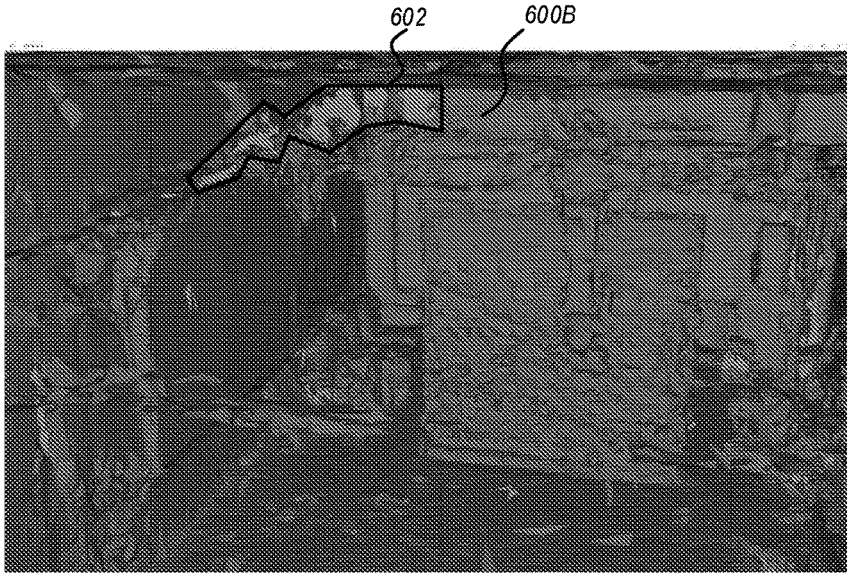
FIG. 6B illustrates a 3D reconstruction of the room (illustrated in FIG. 6A) by the environmentally-based spatial analysis engine.

When the sensing device of a user is sensing the 3D environment, embodiments send the spatial mapping data of the 3D environment around the present location of the user to the environmentally-based spatial analysis engine 210. The environmentally-based spatial analysis engine 210 receives the spatial mapping data from the user's sensing device and reconstructs the 3D environment that the user is in. FIG. 6A shows a panoramic photo of a 3D environment 600A that a user is currently in. It may be a photo or series of photos taken by an imaging sensor that the user is wearing. FIG. 6B shows the reconstructed 3D structure 600B of the room 600A by the environmentally-based spatial analysis engine 210. There may be free-space leaks 602 in the reconstructed structure. A free-space leak is a spot that the spatial mapping data or the metadata of the user location history may have missed and may be deemed as an open space to a computer system. However, the environmentally-based spatial analysis engine 210 may detect a free-space leak as a hole on a wall. Free-space leaks may be caused by one or more of a number of different causes. For example, free-space leaks may be caused by incomplete mapping data. For example, a free-space leak may occur because the user is constantly moving, facing in one direction, before the metadata database of the user location history is sufficient to generate a complete structure of the environment. Alternatively or additionally, a free-space leak may occur due to the nature of materials in the environment. For example, reflective materials can confuse sensors and cause free-space leaks when mapping the environment.

Some embodiments may remediate these free-space leaks by using a free-space leak removal filter. For example, this may be a smoothing filter as described above to remove the effects of the detected free-space leak. That is, the free-space leak would ordinarily cause sudden changes in sound. The smoothing filter will make sudden changes more gradual. In some embodiments, the changes will be sufficiently gradual so as to nearly completely reduce the effects of the free-space leak until sufficient mapping data can be generated to eliminate the free-space leak.

Note that in some embodiments, tracking of a user position may be lost. In some such embodiments, embodiments can revert to a last known good user position for rendering audio. That is, the system can output audio as if the user was in the last location for which the user tracking knew the location of the user.

Figure 7:
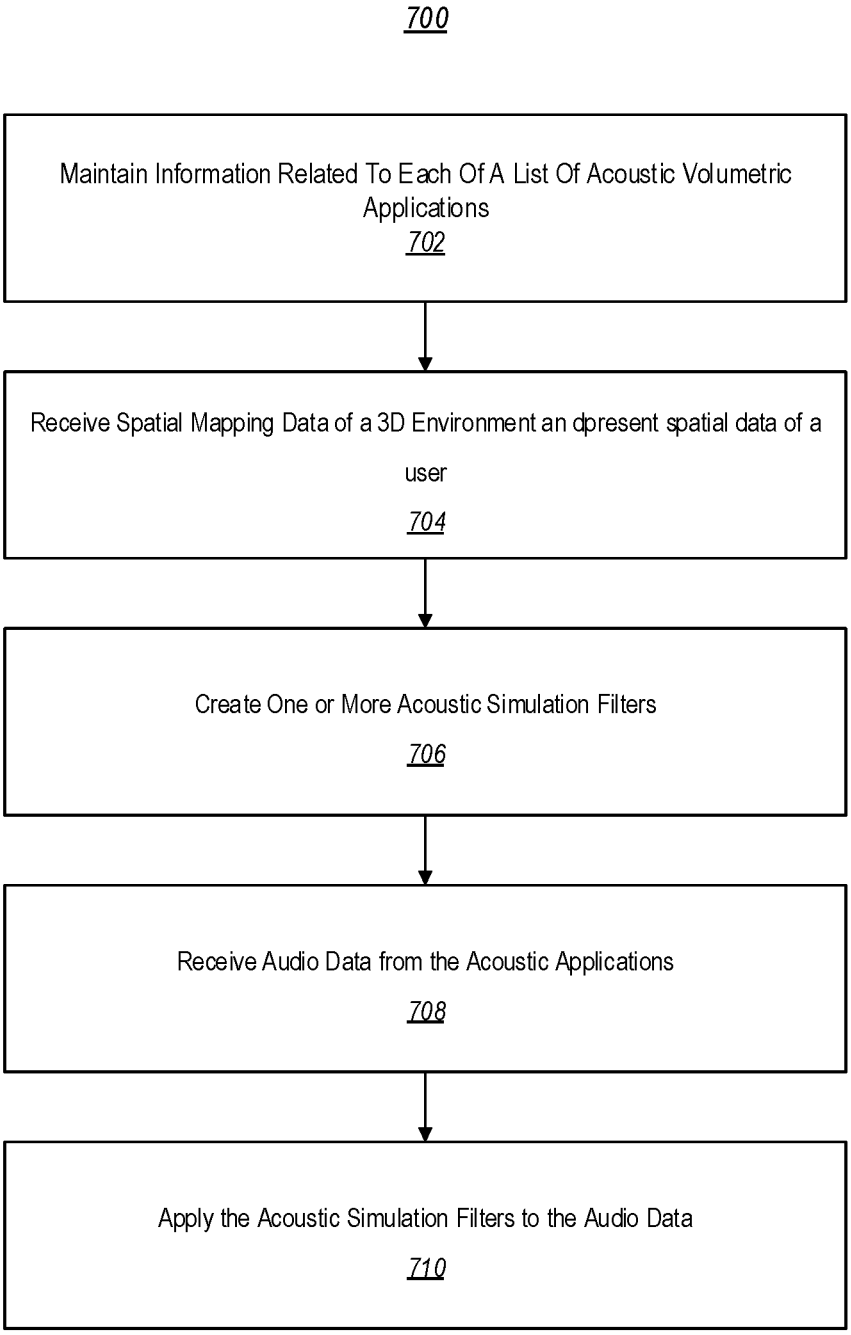

FIG. 7 illustrates a flow chart of a computer implemented method 700 for converting audio data from non-spatially aware applications into 3D audio corresponding to the 3D environment the user is in. The method 700 may be implemented by a computer system with a computer system architecture 201 illustrated in FIG. 2. A computer operating storage device coupled to the computer system may store computer-executable instructions for performing the method 700. The method 700 includes an action of maintaining 702 the information related to each of the acoustic volumetric applications. The method 700 further includes receiving 704 spatial mapping data of a 3D environment and present spatial data of a user. In some embodiments, the method 700 includes using the 3D environment data and users spatial metadata to produce control parameters for acoustic simulation filters. The method 700 further includes creating 706 one or more acoustic simulation filters based on the information related to each of the acoustic volumetric applications, the spatial mapping data of the environment, and the present spatial data of the user. The method 700 further includes receiving 708 audio data from the acoustic volumetric applications. The method 700 further includes applying 710 the acoustic simulation filters to the audio data received from each of the acoustic volumetric applications transforming the non-spatial aware audio to 3D audio.

Figure 8:
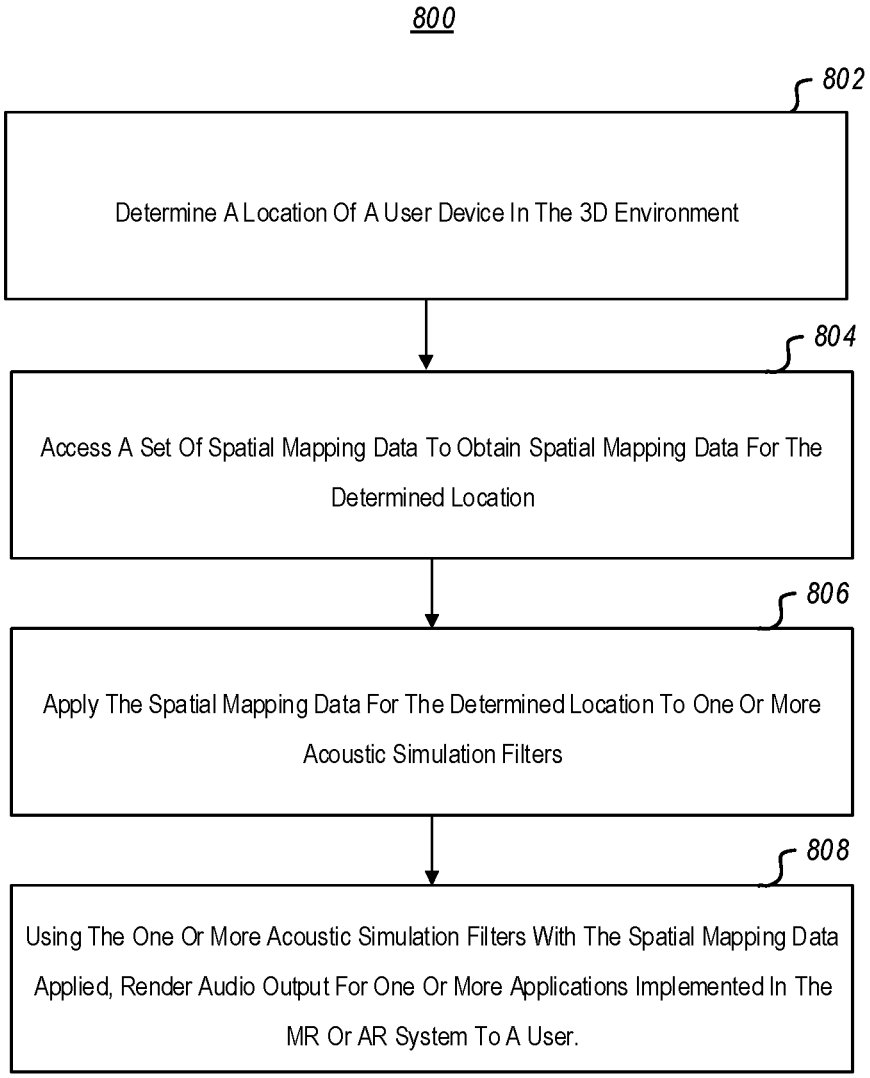
FIG. 8 illustrates a method of rendering audio for applications implemented in a mixed reality or augmented reality system, in a 3D environment.

Referring now to FIG. 8, a method 800 is illustrated the method 800 may be practiced in a MR or AR computing system. The method 800 includes acts for rendering audio for applications implemented in the MR or AR system, in a 3D environment. The method 800 includes determining a location of a user device in the 3D environment (act 802). For example, this may be accomplished by receiving information from sensors such as those illustrated as sensors 207 in FIG. 2.

The method 800 may further include accessing a set of spatial mapping data to obtain spatial mapping data for the determined location (act 804). The spatial mapping data includes spatial mapping of free-space points in the 3D environment. Data for each free-space point includes data related to audio characteristics at that free-space point. The spatial mapping data is based on data provided by users in the 3D environment. For example, as illustrated above, spatial mapping data may be collected from various users in a 3D environment where the mapping data includes various characteristics of the 3D environment, such as barriers, objects in the 3D environment, audio characteristics of the environment, etc.

The method 800 further includes applying the spatial mapping data for the determined location to one or more acoustic simulation filters (act 806).

The method 800 further includes using the one or more acoustic simulation filters with the spatial mapping data applied, rendering audio output for one or more applications implemented in the MR or AR system to a user (act 808).

The method 800 may be practiced where the spatial mapping data comprises filter parameters (e.g., coefficients) for each free-space point that can be applied to the one or more acoustic simulation filters.

The method 800 may be practiced where the spatial mapping data comprises information related to reverberation for each free-space point.

The method 800 may be practiced where the spatial mapping data comprises information, for each free-space point, related to distance from the free-space point to objects (e.g., walls, floor, ceiling, applications, furniture, etc.)

The method 800 may further include recording spatial mapping data for the user as metadata of a free path point in the user's location history. In some such embodiments, the metadata for each of the free-space points in the 3D environment is collected according to a predetermined resolution.

The method 800 may further include using acoustic simulation filters to smooth sudden audio changes that exceed some predetermined threshold. In some such examples, the sudden audio changes are caused by free-space leaks. Alternatively or additionally, the sudden audio changes may include a sudden change in a perceived sound direction. Alternatively or additionally, the sudden audio changes may include a sudden change in a perceived sound volume. Alternatively or additionally, the sudden audio changes may be caused by detecting a change of a boundary of the 3D environment in a pre-determined distance that exceeds a threshold.

Further, the methods may be practiced by a computer system including one or more processors and computer-readable media such as computer memory. In particular, the computer memory may store computer-executable instructions that when executed by one or more processors cause various functions to be performed, such as the acts recited in the embodiments.

Embodiments of the present invention may comprise or utilize a special purpose or general-purpose computer including computer hardware, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are physical storage media. Computer-readable media that carry computer-executable instructions are transmission media. Thus, by way of example, and not limitation, embodiments of the invention can comprise at least two distinctly different kinds of computer-readable media: physical computer-readable storage media and transmission computer-readable media.

Physical computer-readable storage media includes RAM, ROM, EEPROM, CD-ROM or other optical disk storage (such as CDs, DVDs, etc), magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry or desired program code means in the form of computer-executable instructions or data structures and which can be accessed by a general purpose or special purpose computer. Combinations of the above are also included within the scope of computer-readable media.

Further, upon reaching various computer system components, program code means in the form of computer-executable instructions or data structures can be transferred automatically from transmission computer-readable media to physical computer-readable storage media (or vice versa). For example, computer-executable instructions or data structures received over a network or data link can be buffered in RAM within a network interface module (e.g., a "NIC"), and then eventually transferred to computer system RAM and/or to less volatile computer-readable physical storage media at a computer system. Thus, computer-readable physical storage media can be included in computer system components that also (or even primarily) utilize transmission media.

Computer-executable instructions comprise, for example, instructions and data which cause a general purpose computer, special purpose computer, or special purpose processing device to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A computing system comprising:

one or more processors; and one or more computer-readable media having stored thereon instructions that are executable by the one or more processors to configure the computer system to rendering audio for applications implemented in the MR or AR system, including instructions that are executable to configure the computer system to perform at least the following:

determining a location of a user device in the 3D environment;

accessing a set of spatial mapping data to obtain spatial mapping data for the determined location, wherein the spatial mapping data comprises spatial mapping of free-space points in the 3D environment, wherein data for each free-space point comprises data related to audio characteristics at that free-space point, and wherein the spatial mapping data is based on data provided by users in the 3D environment;

applying the spatial mapping data for the determined location to one or more acoustic simulation filters; and using the one or more acoustic simulation filters with the spatial mapping data applied, rendering audio output for one or more applications implemented in the MR or AR system to a user.

2. The system of claim 1, wherein the one or more computer-readable media further have stored thereon instructions that are executable by the one or more processors to configure the computer system to record spatial mapping data for the user as metadata of a free path point in the user's location history.

3. The system of claim 1, wherein the one or more computer-readable media further have stored thereon instructions that are executable by the one or more processors to configure the computer system to use acoustic simulation filters to smooth sudden audio changes that exceed some predetermined threshold.

4. The system of claim 3, wherein the sudden audio changes are caused by free-space leaks.

5. In a MR or AR computing system a method of rendering audio for applications implemented in the MR or AR system, in a 3D environment, the method comprising:

determining a location of a user device in the 3D environment;

accessing a set of spatial mapping data to obtain spatial mapping data for the determined location, wherein the spatial mapping data comprises spatial mapping of free-space points in the 3D environment, wherein data for each free-space point comprises data related to audio characteristics at that free-space point, and wherein the spatial mapping data is based on data provided by users in the 3D environment;

applying the spatial mapping data for the determined location to one or more acoustic simulation filters; and using the one or more acoustic simulation filters with the spatial mapping data applied, rendering audio output for one or more applications implemented in the MR or AR system to a user.

6. The method of claim 5, wherein the spatial mapping data comprises filter parameters for each free-space point that can be applied to the one or more acoustic simulation filters.

7. The method of claim 5, wherein the spatial mapping data comprises information related to reverberation for each free-space point.

8. The method of claim 5, wherein the spatial mapping data comprises information, for each free-space point, related to distance from the free-space point to objects.

9. The method of claim 5, further comprising recording spatial mapping data for the user as metadata of a free path point in the user's location history.

10. The method of claim 9, wherein the metadata for each of the free-space points in the 3D environment is collected according to a predetermined resolution.

11. The method of claim 5, further comprising using acoustic simulation filters to smooth sudden audio changes that exceed some predetermined threshold.

12. The method of claim 11, wherein the sudden audio changes are caused by free-space leaks.

13. The method of claim 11, wherein the sudden audio changes comprise a sudden change in a perceived sound direction.

14. The method of claim 11, wherein the sudden audio changes comprise a sudden change in a perceived sound volume.

15. The method of claim 11, wherein the sudden audio changes are caused by detecting a change of a boundary of the 3D environment in a pre-determined distance that exceeds a threshold.

16. A MR or AR system for rendering audio for acoustic volumetric applications implemented in the system, in a 3D environment, the system comprising:

a location sensor configured to determine a location of the system in the 3D environment;

a shell, comprising a user interface for accessing services of an operating system of the system, the shell hosting one or more acoustic volumetric applications, wherein the shell stores location information identifying one or more locations in the 3D environment where the one or more acoustic volumetric applications are virtually implemented;

an environmentally-based spatial analysis engine coupled to the location sensor and the shell, and configured to receive spatial mapping data mapping characteristics of the 3D environment, the location of the system and the one or more locations in the 3D environment where the one or more acoustic volumetric applications are virtually implemented, and to compute filter parameters using the spatial mapping data, the location of the system, and the one or more locations in the 3D environment where the one or more acoustic volumetric applications are virtually implemented, wherein the spatial mapping data comprises spatial mapping of free-space points in the 3D environment, wherein data for each free-space point comprises data related to audio characteristics at that free-space point, and wherein the spatial mapping data is based on data provided by at least one user in the 3D environment;

an audio mixing engine coupled to the environmentally-based spatial analysis engine and the shell, the audio mixing engine configured to receive audio data from the one or more acoustic volumetric applications and to apply filters to the audio data based on the computed filter parameters; and an audio receiver configured to output the filtered audio data to a user, causing the user to perceive audio from the one or more acoustic volumetric applications as if they were actually implemented in the 3D environment at the locations where the one or more acoustic volumetric applications are virtually implemented.

17. The system of claim 16, wherein the spatial mapping data comprises information, for each free-space point, related to distance from the free-space point to objects.

18. The system of claim 16, wherein the spatial mapping data comprises information from one or more users' location history.

19. The system of claim 18, wherein the spatial mapping data is collected from users according to a predetermined resolution.

20. The system of claim 16, wherein the environmentally-based spatial analysis engine is configured to smooth sudden audio changes caused by free-space leaks that exceed some predetermined threshold.

* * * * *